United States Patent [19]

Yamaguchi et al.

[11] 4,203,084

[45] May 13, 1980

[54] VENTILATED ELECTROMAGNETIC SWITCH

[75] Inventors: Takao Yamaguchi, Nagoya; Kenjiro Aoyama, Okazaki; Yukihiro Nishio, Kariya; Sadayosi Kazino, Nagoya, all of Japan

[73] Assignee: Nippondenso Co., Ltd., Kariya, Japan

[21] Appl. No.: 903,614

[22] Filed: May 8, 1978

[30] Foreign Application Priority Data

May 13, 1977 [JP] Japan ..... 52-62037[U]

[51] Int. Cl.[2] ..... H01H 45/12; H01H 9/02

[52] U.S. Cl. ..... 335/202; 200/306; 335/156

[58] Field of Search ..... 200/306, 19 R, 19 DC; 335/202, 201, 156, 255

[56] References Cited

U.S. PATENT DOCUMENTS

| | | | |
|---|---|---|---|
| 1,928,846 | 10/1933 | Allen | 335/156 |
| 2,589,024 | 11/1952 | Peter | 335/156 |
| 3,328,553 | 6/1967 | Gryctko | 200/306 |
| 3,336,457 | 8/1967 | Julian et al. | 200/19 R |
| 3,973,477 | 8/1976 | Jakob et al. | 200/306 |

*Primary Examiner*—Harold Broome

*Attorney, Agent, or Firm*—Cushman, Darby & Cushman

[57] ABSTRACT

An electromagnetic switch has a movable contact and a stationary contact accommodated and sealed in a container of a given shape. In the container, there are provided at the axial top and bottom of the container, meander venting paths for communicating the inside of the container with surrounding atmosphere. The ventilation of the inside of the container is thus effectively attained by the meander paths so that the formation of ice on the stationary contact can be prevented.

6 Claims, 4 Drawing Figures

VENTILATED ELECTROMAGNETIC SWITCH

BACKGROUND OF THE INVENTION

The present invention relates to an electromagnetic switch for actuating contacts by an electromagnetic mechanism, which is referred to as a "magnet switch" and is primarily mounted in a start motor for an internal combustion engine, and more particularly to a structure for protecting the contacts thereof from being iced.

Heretofore, in a well known electromagnetic switch of this type, when water which enters into the switch structure from the exterior or water generated from an electromagnetic coil which is a component of an electromagnet is cooled by the surrounding atmosphere, a film of ice is formed on a contact surface of a contact. This impedes the switching function.

SUMMARY OF THE INVENTION

It is an object of the present invention to form a venting path communicating a contact chamber with the surrounding atmosphere through a meander path in a switch cover which defines the contact chamber to allow ventilation while attaining a water-proof structure in order to prevent a film of ice from being formed on the surface of the contact by rapid cooling. The venting path meanders, that is, it has a complex meander path (a kind of maze) to communicate the contact chamber with the surrounding atmosphere. Therefore, the ventilation of the contact chamber is enhanced without aiding entrance of the water into the contact chamber from the surrounding atmosphere.

Preferably, a plurality of independent venting paths are provided with one of which being located at the bottom in the mounting position of the switch and downward to the surrounding atmosphere so that it also functions as a drain port.

Furthermore, according to the present invention, an electromagnet switch suitable for use in a particular application can be provided.

It has been proved by experiment by the inventors of the present invention that in an electromagnetic switch or a so-called magnet switch mounted on a starter motor for an internal combustion engine, a special icing phenomenon takes place. In the electromagnetic switch of this type, a battery cable for electrical connection to a battery is connected to one stationary contact. When an automobile or the like in which is mounted an internal combustion engine is operated in a surrounding atmosphere of several tens of degrees below freezing point, the electromagnetic switch is heated to substantially the same temperature as that of the internal combustion engine. When the operation is stopped thereafter and the engine is left stopped, the battery cable having a relatively large outer surface area relative to a volume thereof is rapidly cooled by the surrounding atmosphere so that the stationary contact connected to the cable is rapidly cooled. As a result, wet air within the contact chamber gathers to the stationary contact and is frozen thereat.

According to the present invention, in the electromagnetic switch of this type, the venting path opens into the contact chamber at a position near the stationary contact connected to the battery cable in order to prevent the icing at the stationary contact.

DESCRIPTION OF THE PREFERRED EMBODIMENTS

Figure 1:
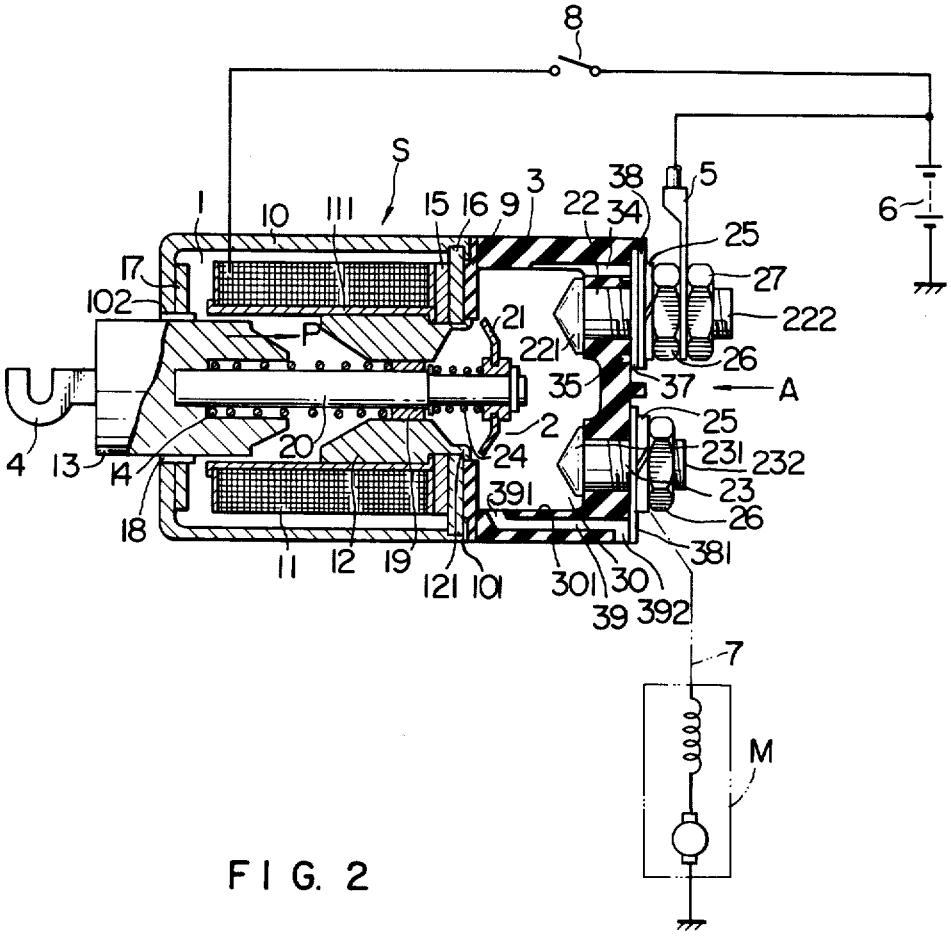
FIG. 1 is a longitudinal sectional view showing a first embodiment of an electromagnetic switch of the present invention.

The present invention is now explained in detail with reference to the illustrated embodiments of the invention. Each embodiment shows an electromagnetic switch used as the magnet switch to be mounted on the start motor for the internal combustion engine. In FIG. 1 which shows a first embodiment, an electromagnetic switch generally indicated by a numeral 8 comprises an electromagnet 1, a contact member 2 adapted to be driven by the electromagnet, and a switch cover 3 which accomodates the contact member therein.

The electromagnet 1 is of a well known structure and comprises an electromagnet casing 10 of magnetic plate which forms a portion of a magnetic circuit, an electromagnetic coil 11 mounted in the casing 10, a stationary core 12 of hollow cylindrical structure adapted to be magnetized by the coil 11, a movable core 13 adapted to be attracted to the stationary core 12 and a return spring 14 mounted between the cores 12 and 13. A bobbin 111 on which the electromagnetic coil 11 is wound, together with an auxiliary bobbin 15 and an auxiliary yoke 16 are fixed to the stationary core 12 at a caulking position 121, and an outer circumference of the auxiliary yoke 16 is fixed to an open end of the case 10, that is, the cup-shaped casing having a U-shape axial cross-section, at a caulking position 101. The movable core 13 is slidably carried in an opening 102 (with an auxiliary yoke 17) formed at a center of the bottom of the casing 10, through a busing 18. A contact support bar 20 which is slidably mounted to the stationary core 12 through a bush 19 is fixed to one end of the core 13, and a link arm 4 is fixed to the other end of the core 13. The link arm 4 is lever-coupled to a pinion shifting device, not shown, of a start motor M in a well known manner.

A movable contact 21 is mounted at an end of the contact support bar 20 and electrically insulated therefrom. The contact 21 is spring-held to the contact support bar 20 by a contact spring 24 so that the contact 21 contacts with a pair of stationary contacts 22 and 23 at a given pressing force.

In the contact member 2 comprising the parts 20 to 24 described above, each of the pair of stationary contacts 22 and 23 is of terminal bolt structure with a head 221 or 231 thereof located within the switch cover 3 to face the movable contact 21 and with a threaded portion 222 or 232 extending externally of the switch cover 3 being clamped and fixed to the cover 3 by a spring washer 25 and a nut 26. One of the stationary contacts, that is, the first stationary contact 22 has the longer threaded portion 222 than the second stationary contact 23, and one end of a battery cable 5 is clamped and fixed to the threaded portion 222 by the nut 26 and another nut 27.

The other end of the cable 5 is connected to a positive terminal of a battery 6 having a negative terminal grounded. Thus, the first stationary contact 22 is in electrical connection with the positive terminal of the battery 6 through the battery cable 5. The second stationary contact 23 is connected to one end of the starter motor M through an appropriate wire 7 while the other end of the starter motor M is grounded.

The electromagnetic coil 11 of the electromagnet 1 is connected to the battery 6 through a starter switch 8 so that it is energized by the actuation of the switch 8.

With the electromagnet 1 and the contact member 2 thus constructed, a well-known magnet switch function is attained. In the starting operation of the engine, when the starter switch 8 is turned on, the electromagnetic coil 11 is energized so that the movable core 13 is attracted to the stationary core 12 against the force of the return spring 14 and moved to the right as shown by an arrow P. As a result, a pinion of the starter motor M is meshed with a gear ring of the engine by the link arm 4, and the movable contact 21 is urged against the pair of stationary contacts 22 and 23, particularly the heads 221 and 231 thereof, by the contact support bar 20. As a result, a conduction path from the battery 6 through the battery cable 5, the first stationary contact 22, the movable contact 21, the second stationary contact 23 and the starter motor M to ground is established and the starter motor M rotates to drive the engine. When the engine has been completely started, the starter switch 8 is opened and the initial state is restored.

The characteristic feature of the electromagnetic switch of the present invention resides in the switch cover 3. The switch cover 3 is made of a resin mold and has a generally U-shape in axial cross-section. The open end thereof is fixed by a well known means to the electromagnet 1 through a packing 9. A space surrounded by the packing 9 and the inner wall of the cover 3 defines the contact chamber 30 in which the contact member 2 is accommodated. The contact chamber 30 is shielded from the surrounding atmosphere by the packing 9.

Figure 2:
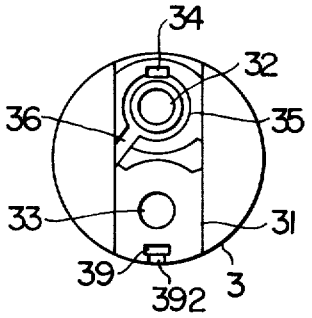
FIG. 2 shows an external view of a switch cover of the electromagnetic switch shown in FIG. 1, as viewed in the direction of an arrow A shown in FIG. 1.

As shown in FIG. 2, the switch cover 3 has an axially extending platform 31 at the top, at which first and second via-holes 32 and 33 having circular cross-section, through which the threaded portions 222 and 232 of the first and second stationary contacts 22 and 23, respectively, are inserted and a third via-hole 34 having a rectangular cross-section and acting as a venting path are formed to extend axially through the cover. Furthermore, on the top surface of the platform 31, there are formed a ring-shaped recess 35 which surrounds the first via-hole 32 and an oblique recess 36 having one end thereof opening to the recess 35 and the other end thereof opening to the side of the platform 31. A portion of the outer circumferences of the ring-shaped recess 35 overlaps with a portion of the third via-hole 34 so that the recess 35 and the via-hole 34 are in communication.

A packing 37 and an overlying plate 38 are placed on the top surface of the platform 31 to cover the top openings of the third via-hole 34, the ring-shaped recess 35 and the oblique recess 36. The third via-hole 34 is located at the top in the mounting position of the electromagnetic switch (the position shown in FIG. 1), and it extends around the periphery of the head 221 of the first stationary contact 22, along the inner cylindrical wall of the cover 3 and opens into the contact chamber 30.

Thus, a first meander venting path is formed by the third via-hole 34, the ring-shaped recess 35 and the oblique recess 36, to communicate the contact chamber 30 with the surrounding atmosphere therethrough.

The switch cover 3 further has an axially extending hole 39 extending through a cylinder located at the bottom in the mounting position of the electromagnetic switch. One end of the hole 39 opens into the contact chamber 30 through an oblique hole 391 near the open end of the cover 3, and the other end of the hole 39 opens from the top surface of the platform 31 as shown in FIG. 2 and also opens downward through a downward recess 392. The top openings of the hole 39 and the recess 392 are also covered with the plate 381 so that a second meander venting path is formed by the oblique hole 391, the hole 39 and the recess 392, and the contact chamber 30 is communicated with the surrounding atmosphere through the second venting path, too. As is apparent from the mounting position shown in FIG. 1, the second venting path extends to shift the bottom 301 of the contact chamber 30 stepwise and downwardly to function as a drain port for draining water accumulated in the contact chamber 30.

It should be understood that the packing 37 and the plates 38 and 381 are clamped and fixed to the switch cover 3 together with the stationary contacts 22 and 23 by the spring washers 25 and the nuts 26.

With the construction described above, since the contact chamber 30 communicates with the surrounding atmosphere through the first venting path formed by the third via-hole 34, the ring-shaped recess 35 and the oblique recess 36 and through the second venting path formed by the oblique hole 391, the hole 39 and the recess 392, and the both venting paths are meander like mazes and open downward to the surrounding atmosphere through the recesses 36 and 392, water does not enter through the venting paths and the contact chamber 30 is effectively vented through the venting paths. If an excess amount of water should be generated in the contact chamber 30, the water accumulated at the bottom 301 of the contact chamber 30 can be effectively drained out of the switch through the second venting path.

When the engine is operated in the surrounding atmosphere of several tens of degrees below freezing point, the electromagnetic switch as well as the battery cable 5 are heated to the substantially same temperature as that of the engine, but when the engine is subsequently left stopped, the battery cable 5 is rapidly cooled by the surrounding atmosphere because it has a relatively large outer surface area relative to its volume. Accordingly, the first stationary contact 22 connected to the cable 5 is rapidly cooled. However, since external dry air of the surrounding atmosphere is introduced into the contact chamber 30 by the venting function described above, humidity in the contact chamber is very low. A humidity of atmosphere around the head 221 of the stationary contact 22 is particularly very low because the first venting path is located near the stationary contact 22. Therefore, icing does not occur at the head 221.

The second stationary contact 23 and the movable contact 21 are cooled more slowly than the first stationary contact 22. Therefore, so long as the icing does not occur at the first stationary contact 22, it does not occur at the contacts 23 and 21.

Figure 3:
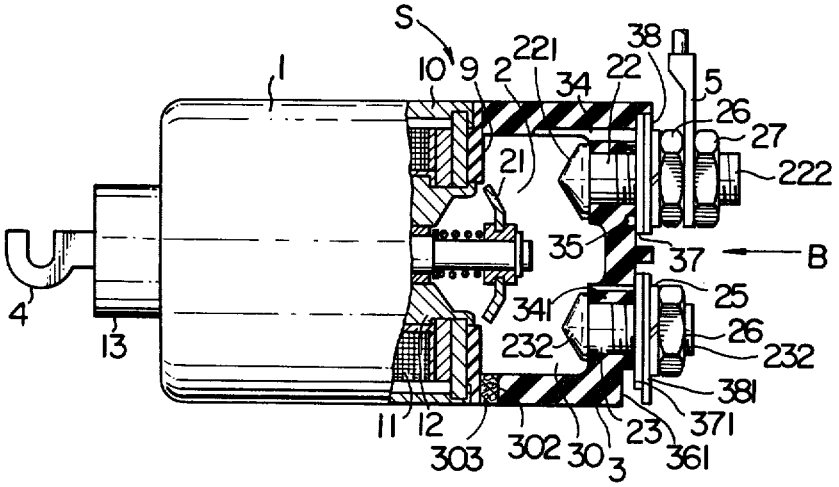
FIG. 3 is a fragmentary longitudinal sectional view of a second embodiment of the electromagnetic switch of the present invention.
Figure 4:
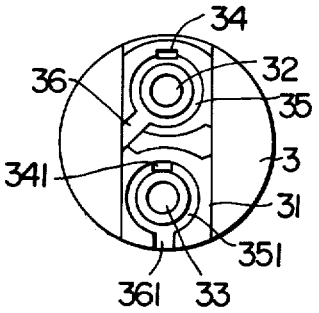
FIG. 4 is an external view of a switch cover of the electromagnetic switch shown in FIG. 3, as viewed in the direction of an arrow B shown in FIG. 3.

FIGS. 3 and 4 show a second embodiment of the present invention, which differs from the first embodiment in that it has first and second venting paths exclusively used for ventilation and a separate drain path exclusively used for draining. In FIGS. 3 and 4, the first venting path is of the same structure as that of the first embodiment and comprises the third via-hole 34, the ring-shaped recess 35 and the oblique recess 36. The second venting path is of substantially the same structure as that of the first venting path and comprises a ring-shaped recess 351 which corresponds to the ring-shaped recess 35 and formed to surround the second via-hole 33 in which the threaded portion 232 of the second stationary contact 23 is inserted, a fourth via-hole 341 which corresponds to the third via-hole 34 and a straight recess 361 which corresponds to the oblique recess 36 and opens downward. Mounted between the top surface of the platform 31 and the plate 381 is a packing 371 which covers the top openings of the via-hole 341 and the recess 351. The contact chamber 30 communicates with the surrounding atmosphere through the path formed by the fourth via-hole 341, the ring-shaped recess 351 and the straight recess 361.

In the mounting position of the electromagnetic switch, each of the first and second venting paths bends downward at right angle from the overlying via-hole 34 or 341, passes through the ring-shaped recess 35 or 351 to the lower position, and extends further downward and opens to the atmosphere. Thus, the level difference between the opening of the venting path to the contact chamber 30 and the opening of the venting path to the atmosphere is very large so that the entrance of water into the contact chamber 30 through the venting path is prevented more positively than in the first embodiment.

On the other hand, a notch 302 acting as a drain path is formed at the bottom in the mounting position of the electromagnetic switch, on the side of the open end of the switch cover 3. A felt pad 303 for preventing the entrance of water is mounted in the notch 302. Thus, the notch 302 functions to effectively drain water within the contact chamber 30 without introducing water.

In the first and second embodiments described above, the holes and the recesses formed in the switch cover 3 to provide the first and second venting paths and the drain path may be formed simultaneously with the manufacture of the switch cover 3 by molding the resin and hence no substantial after-treatment is required. In the first embodiment, all of the holes and the recesses except the oblique hole 391 can be formed simultaneously and only the post-treatment for forming the oblique hole 391 is additionally required.

As described in detail with respect to the second embodiment, the positions and the numbers of the venting paths and the drain paths and the pattern of mander path are not limited to the illustrated embodiments but various modifications can be made as required.

As described hereinabove, according to the present invention, since the venting paths which communicate the contact chamber defined in the switch cover with the surrounding atmosphere through meander paths are provided in the switch cover, the contact chamber can be effectively vented without introducing water into the contact chamber. Accordingly, icing at the contact member is prevented even when the contact member housed in the contact chamber is rapidly cooled.

What is claimed is:

1. A ventilated electromagnetic switch comprising:
an electromagnet casing;
a coil mounted in said casing;
a stationary magnetic core mounted to be magnetized by said coil;
a movable magnetic core mounted to be attracted to said stationary magnetic core;
a switch cover mounted to said electromagnetic casing to define a contact chamber therein; and
a contact member arranged in said contact chamber and mounted to be actuated and deactuated by the movement of said movable magnetic core;
said switch cover being provided with at least two meander paths formed therein to independently communicate the inside of said contact chamber with the surrounding atmosphere.

2. A ventilated electromagnetic switch according to claim 1 wherein said contact member includes
a movable contact mounted on said movable magnetic core and
a pair of first and second stationary contacts mounted on said switch cover and adapted to be bridged by said movable contact, said first stationary contact being connected to a battery through a battery cable and said second stationary contact being connected to an apparatus which is powered by said battery.

3. A ventilated electromagnetic switch according to claim 1 wherein one of said meander paths is located at the bottom in the mounting position of the switch and opens downward to the surrounding atmosphere to function as a drain path.

4. A ventilated electromagnetic switch according to claim 2 wherein said meander path opens into said contact chamber at a position near said first stationary contact.

5. A ventilated electromagnetic switch comprising:
an electromagnet casing;
a coil mounted in said casing;
a stationary magnetic core mounted to be magnetized by said coil;
a movable magnetic core mounted to be attracted to said stationary magnetic core;
a switch cover of cup shape having a U-shape axial sectional area, said cover being mounted to said electromagnetic casing to define a contact chamber therein;
a contact member arranged in said contact chamber and mounted to be actuated and deactuated by the movement of said movable magnetic core, said contact member including a movable contact mounted on said movable magnetic core and a pair of first and second stationary contacts mounted at the top of said switch cover and extending therethrough, said pair of stationary contacts being adapted to be bridged by said movable contact, said first stationary contact being connected to a battery through a battery cable and said second stationary contact being connected to an apparatus which is powered by said battery; and
a meander path formed in said cover to communicate the inside of the contact chamber with the surrounding atmosphere, said path including a ring-shaped recess which surrounds the periphery of said first stationary contact on an outer surface at the top of said switch cover, said recess being closed by a cover with a portion thereof opening to the surrounding atmosphere.

6. A ventilated electromagnetic switch according to claim 5 wherein said meander path includes an axial hole which extends through said switch cover, said hole having one end thereof opening into said recess and the other end thereof opening into said contact chamber.

* * * * *